US005168789A

United States Patent [19]

Suzuki

[11] Patent Number: 5,168,789

[45] Date of Patent: Dec. 8, 1992

[54] MULTI-COLUMNED NEEDLEWOVEN STRIPS AND METHOD FOR FORMING THEM

[75] Inventor: Aiko Suzuki, Tokyo, Japan

[73] Assignee: Clover Mfg. Co., Ltd., Osaka, Japan

[21] Appl. No.: 522,838

[22] Filed: May 14, 1990

Related U.S. Application Data

[63] Continuation-in-part of Ser. No. 386,733, Jul. 31, 1989, abandoned.

[51] Int. Cl.[5] ..... D04C 1/06

[52] U.S. Cl. ..... 87/6; 87/13

[58] Field of Search ..... 87/3, 4, 5, 6, 7, 8, 87/9, 11, 13

[56] References Cited

U.S. PATENT DOCUMENTS

| | | | |
|---|---|---|---|
| 1,499,314 | 6/1924 | Cobb | 87/4 |
| 2,880,493 | 4/1959 | Mitchell | 87/6 X |
| 3,153,366 | 10/1964 | Iwai | 87/7 |
| 3,323,406 | 6/1967 | Mitchell | 87/7 |
| 3,344,699 | 10/1967 | Ohno | 87/7 |
| 3,481,245 | 12/1969 | Kamitani | 87/6 |

FOREIGN PATENT DOCUMENTS

| | | | |
|---|---|---|---|
| 52-11893 | 4/1977 | Japan | 87/6 |

*Primary Examiner*—Joseph J. Hail, III

*Attorney, Agent, or Firm*—William H. Eilberg

[57] ABSTRACT

A multi-columned needlewoven strip comprising two or three columns each formed of a series of loops of surface yarns and disposed side-by-side in which each of the loops of a surface yarn forming one column has a pair of loop-closing portions interlocked with another surface yarn forming another column disposed adjacent to the one column; and the multi-columned needlewoven strip is formed by a method which comprises steps of: threading core yarns respectively through respective eyes formed in a lower end of each of weaving needles so as to provide cores each hanging down from the respective lower ends of the needles; forming a slip knot in a lower end of each of the surface yarns; sliding the slip knot onto each of the needles; wounding the surface yarns around the respective needles to form columns of loops so that each of the loops of the one column is formed with a pair of loop-closing portions interlocked with the cooperating surface yarn forming the other column, and sliding down the columns onto the core yarns to form the multi-columned needlewoven strip.

7 Claims, 6 Drawing Sheets

MULTI-COLUMNED NEEDLEWOVEN STRIPS AND METHOD FOR FORMING THEM

PRIOR APPLICATION

This is a continuation-in-part of my co-pending application Ser. No. 386,733, filed Jul. 31, 1989 now abandoned.

BACKGROUND OF THE INVENTION

1. Field of the Invention

This invention relates to manual needleweaving in the field of handicraft and, more particularly, to multi-columned needlewoven strips and a method for forming them.

Such needlewoven strips may be assembled, by sewing together for example, into various intended projects such as tapestries, mats, shawls, sweaters, cushions, etc. which are substantially two- or three-dimensional in shape.

The strips may also be assembled together into a patch that has a particular ornamental pattern and can be attached, independently or in combination with others, to a desired fabric or other surface of an article for the purpose of ornamentation or decoration.

The invention does not relate to a particular type of weaving needle per se that has an eye formed in its lower end portion and is designed for performing the needleweaving method according to the present invention. 2. Description of the Relevant Art The weaving needle to be used for performing the method of the present invention is already proposed by the Inventor of the present invention in Japanese Patent No. 884,970 (Publication No. 52-11893, published Apr. 2, 1977; Application No. 47-100965, filed Oct. 6, 1972).

Also proposed in the above Japanese Patent No. 884,970 is a certain needleweaving method which is closely relevant to the present invention. In this known method as well as in the method according to the present invention, a plurality of known weaving needles, known core yarns, and surface yarns, are used to make the same types of needlewoven projects as mentioned in the foregoing.

In either method, the core yarns are threaded respectively through the eyes of the weaving needles to provide hanging cores for supporting loops of the surface yarns thereon, substantially in the same manner and for the same purpose.

In the known method, however, the looping way of the surface yarns is different from that in the present invention, which causes a certain inconvenience as will be described in detail hereinbelow with reference to FIGS 9A to 9D and 10A to 10C of the accompanying drawings.

FIGS. 9A to 9D illustrate a first variation of the known method in which a pair of weaving needles 1*a*, 1*b*, two pairs of core yarns 2, each having a predetermined length and color, and a plurality of surface yarns 3*a*, 3*b*, . . . , each having a predetermined length and color, are used to form a two-columned woven strip 6 having a predetermined number of strip parts 8*a*, 8*b*, 8*c*, 8*d*.

Each of the two needles, 1*a*, 1*b* has an eye 4 formed in a lower end cone 5 thereof.

In operation, each of the core yarns 2 is threaded through the eye 4, with both ends hanging down to provide a core for each of two columns 6*a*, 6*b* to be formed of loops 7*a*, 7*b* of the surface yarns 3*a*, 3*b*, . . . , as illustrated in FIGS. 9B and 9C.

Before starting the weaving, the first surface yarn 3*a* is tied in its lower end into a slip knot 7, which is slid onto the first or left needle 1*a*.

In the weaving operation, the loops 7*a*, 7*b* are formed when the first surface yarn 3*a*, starting from the knot 7, is brought clockwise under and over the second or right needle 1*b*, and then counterclockwise under and over the first or left needle 1*a*. The same steps are repeated as the weaving continues by crisscrossing the surface yarn 3*a* in the shape of a "FIG. 8", as illustrated in FIG. 9B.

After the surface yarn 3*a* is woven into the first strip part 8*a* on the needles 1*a*, 1*b*, it may be slid down onto the hanging cores 2, while the second surface yarn 3*b* is woven into the second strip part 8*b* on the needles in the same manner as described, as shown in FIG. 9C. By repeating such steps, a two-columned needlewoven strip 6 having the columns 6*a*, 6*b* is obtained. The needlewoven strip 6 may have a plurality of strip parts 8*a*, 8*b*, 8*c*, 8*d*, . . . closely disposed along the length of the cores 2, as shown in FIG. 9D.

Thus, by selecting colors of the surface yarns 3*a*, 3*b*, . . . , the two-columned needlewoven strip 6 may be made to have a laterally-striped pattern of various color combinations.

According to the known method as described above, however, it is impossible to make the color of the first column 6*a* different from that of the second column 6*b*. In other words, the known method does not provide a needlewoven strip 6 with a vertically-striped pattern of two different colors or with a staggered color pattern.

Further, it will be easily understood that the needlewoven strip 6 will be easily disassembled if one of the two cores is removed from the strip 6.

FIGS. 10A to 10C show a second variation of the known method in which five weaving needles 1*a*, 1*b*, 1*c*, 1*d*, 1*e*, each having an eye 4, are used to form a five-columned needlewoven strip 6'.

In operation, five pairs of core yarns 2 are threaded through the respective eyes 4 to provide five hanging cores for the five columns 6*p*, 6*q*, 6*r*, 6*s*, 6*t* which are formed of the surface yarns 3*p*, 3*q*, . . . , in which the surface yarns are formed into loops 7*p*, 7*t* only on the end needles 1*a*, 1*e* as illustrated in FIG. 10A to 10C.

After the first surface yarn 3*p* is engaged with the first needle 1*a* by putting its lower end slip knot 7 onto the first needle 1*a*, the yarn 3*p* starting from the slip knot 7, is brought over the second needle 1*b*, under the third needle 1*c*, over the fourth needle 1*d*, and then under and over the fifth or last needle 1*e*. Subsequently, the surface yarn 3*p* is brought back under the fourth needle 1*d*, over the third needle 1*c*, under the second needle 1*b*, and over and under the first needle 1*a*, as best shown in FIG. 10A. The same steps are repeated as the weaving continues.

After the first surface yarn 3*p* is woven into the first strip part 8*p*, it may be slid down onto the hanging cores 2, while the second surface yarn 3*q* is woven into a second strip part 8*q* in the same manner as described, as shown in FIG. 10B. By repeating such steps, it is possible to obtain a five-columned needlewoven strip 6' having a plurality of strip parts 8*p*, 8*q*, 8*r*, 8*s*, . . . for an intended project, as shown in FIG. 10C.

Also in the second variation of the known method, the five-columned needlewoven strip 6' may be made to have a laterally-striped pattern of various color combinations, by simply selecting colors of the surface yarns 3p, 3q, . . . . However, the five-columned woven strip 6' cannot be made to have a vertically-striped pattern of different colors.

Further, the needlewoven strip 6' will also be easily disassembled or broken or if one or more of the cores 2 are removed from the strip 6'.

Therefore, the known method described above has a disadvantage in that the respective columns of a multi-columned needlewoven strip must have an identical color pattern, which results in a limited range of selectable patterns for the needlewoven projects.

The known method has another disadvantage in that a core yarn is always required for each column of a needlewoven strip and in that such needlewoven strip will be broken or disassembled when one of the core yarns are removed. Consequently, very thin needlewoven projects are not possible because a whole sectional thickness of each strip cannot be less than a total value of the thickness of the surface yarns plus the thickness of the core yarn or yarns.

Further, in needlewoven strip formed in accordance with the known method, the loops of the surface yarn on one needle are not interlocked with those of the surface yarns on any adjacent needle. Naturally, the loops are easily movable undesirably along the length of the strip. Thus, the needlewoven strip is disadvantageous in that the loops are unstable.

On the other hand, it is well known in the field of weaving that interlocking of the yarns makes a woven strip firm and stable and that complicated interlocking of the yarns is possible when a specifically designed weaving machine or apparatus is used, as disclosed, for example, in U.S. Pat. No. 3,323,406 to Mitchell.

Disclosed in Mitchell is a braid which has a first set of two or more core yarns disposed lengthwise side-by-side and in a common plane with a set of two other core yarns, a group of surface yarns braided about one of the sets of core yarns, another group of surface yarns braided about the other set of core yarns, in which a surface yarn of each group is interlocked once with a surface yarn of the other group along the length of the braid.

Mitchell's braid appears very firm and stable. However, it appears very difficult or almost impossible to form such braid in manual operation, without using the weaving apparatus disclosed in Mitchell.

SUMMARY OF THE INVENTION

It is, therefore, an object of the present invention to provide stable, multi-columned needlewoven strips with interlocked loops, which can be formed by manipulating two or three of a particular type of weaving needles known per se, without using any weaving machine or apparatus.

Another object of the invention is to provide an improved needleweaving method for forming multi-columned needlewoven strips, which can broaden the range of pattern selection for intended projects, when used in combination with the known method as described above.

A further object of the invention is to make it possible to provide multi-columned needlewoven strips each having a pattern of vertical stripes different in color.

A further object of the invention is to permit removal of all or some core yarns from a multi-columned needlewoven strip, thereby reducing the thickness of the finished strip.

Other objects, features and advantages of the invention will become apparent from the detailed description given hereinafter.

According to the present invention, there is provided a particular type of multi-columned needlewoven strips comprising two or three columns each formed of loops, wherein a first column is formed of a first surface yarn which is helically disposed about a first core yarn formed into loops each having a pair of loop-closing portions while a second column is formed of a second surface yarn which is disposed about a second core yarn and formed into loops each having a pair of loop-closing portions, and each pair of loop-closing portions of the first surface yarn are interlocked with the second surface yarn; and, if desired, a third column may be provided, which is formed of a third surface yarn disposed about a third core yarn which is interlocked with each pair of the loop-closing portions of the second surface yarn.

According to the invention, there is also provided a needleweaving method for forming multi-columned needlewoven strips which comprises the steps of: threading core yarns through respective eyes formed in a lower end of weaving needles so as to provide hanging cores; forming a slip knot in a lower end of each of surface yarns; sliding the slip knot onto each of the needles; looping each of the surface yarns around the respective weaving needles to form a column of loops so that each of the loops of the one column is formed with a pair of loop-closing portions interlocked with the cooperating surface yarn forming the other column; sliding down the columns onto the core yarns to form a multi-columned needlewoven strip for an intended project, in which the needlewoven strip may have various patterns including patterns of vertical stripes differing in colors by mere selection of color combination of the surface yarns.

DETAILED DESCRIPTION

Figure 1A:
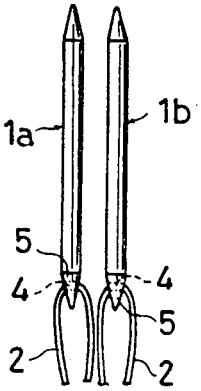
FIGS. 1A to 1J are views showing the successive steps for making a two-colored needlewoven strip according to the invention.

Referring now to the drawings, in which identical reference numerals are used throughout various views to designate identical or similar parts or elements, FIGS. 1A to 1J illustrate one example of the present invention for making a two-columned needlewoven strip.

In the example, a pair of weaving needles 1*a*, 1*b* are used, each of which has an eye 4 formed in its lower end portion 5. A pair of core yarns 2, each having a predetermined length and color, are threaded through the respective eyes 4 of the needles 1*a*, 1*b* so as to hang down therefrom, as shown in FIG. 1A. Each of the core yarns 2 is illustrated as having only one strand, but it may be formed by two or more strands.

Also used in the example are a plural pairs of surface yarns 10*a*–10*b*, 20*a*–20*b*, . . . , in which each pair consists of a first or left surface yarn and a second or right surface yarn each having a predetermined length and color. Each of such yarns is illustrated as formed by a single strand but it may be formed by two or more strands.

Figure 1B:
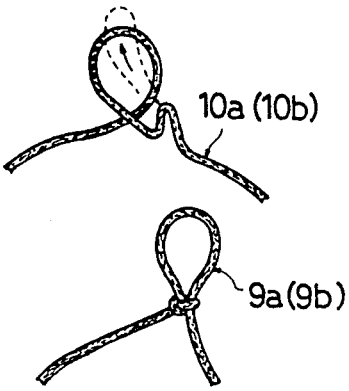
Figure 1C:
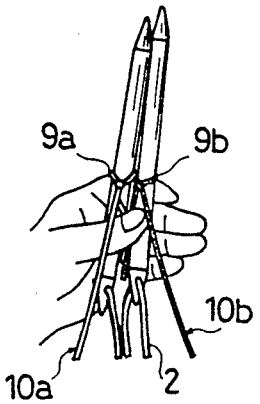

Before starting the weaving, a first pair of surface yarns 10*a* 10*b* are tied in their respective lower ends into slip knots 9*a*, 9*b* as shown in FIG. 1B. The knots 9*a*, 9*b* thus formed are slid onto the needles 1*a*, 1*b*, respectively, as illustrated in FIG. 1C.

Figure 1D:
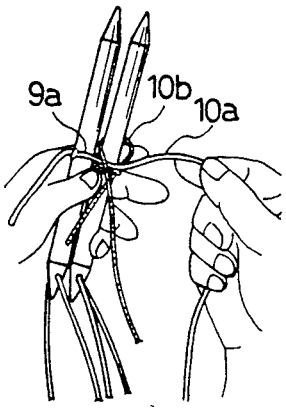
Figure 1E:
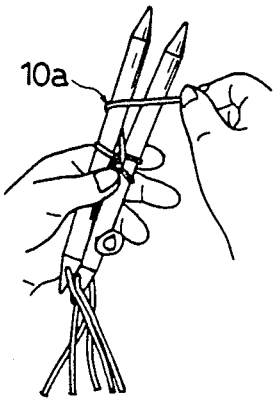
Figure 1F:
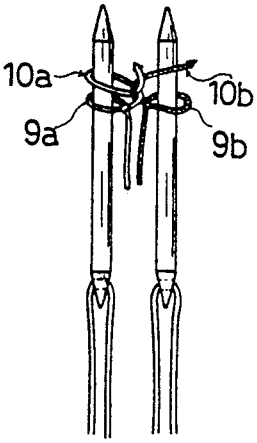

In the weaving operation the first surface yarn 10*a* is looped or wound counterclockwise around the first needle 1*a* and interlocked with the second surface yarn 10*b*, as illustrated in FIGS. 1D and 1E. Then, the second yarn 10*b* is looped or wound counterclockwise around the second needle 1*b*, and interlocked with the first yarn 10*a* as illustrated in FIG. IF.

Figure 1G:
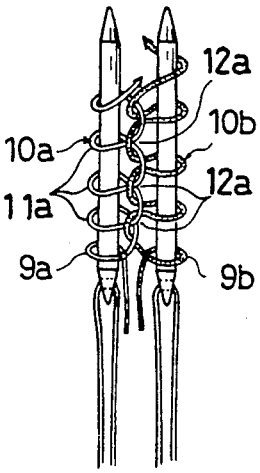
Figure 1H:
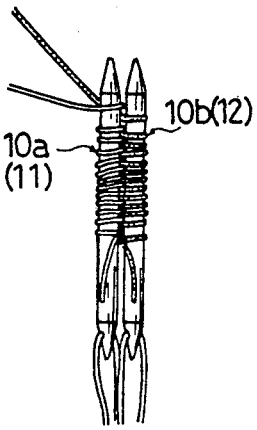

To continue weaving, the first and second surface yarns 10*a*, 10*b* are alternately looped around the needles 1*a*, 1*b* in the same manner as described, as illustrated in FIGS. 1G.

As a result a first two-columned strip part 10 is obtained which includes left and right columns 11, 12, each having a desired number of loops of the surface yarns 10*a*, 10*b*, respectively. More particularly, the first surface yarn 10*a* is formed into a first series of loops 11*a* disposed about the first needle 1*a*, and each of the first series loops 11*a* is interlocked with and closed by the second surface yarn 10*b* at 12*a* as illustrated in FIG. 1G.

Figure 1I:
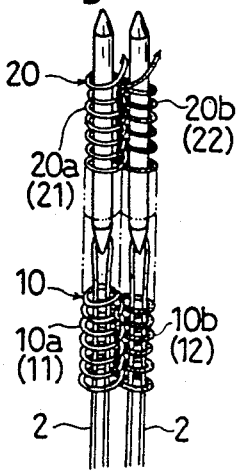

After the first pair of surface yarns 10*a*, 10*b* are needlewoven into the first two-columned strip part 10, the part 10 is slid down onto the hanging core yarns 2, while a second pair of surface yarns 20*a*, 20*b* are needlewoven into a second two-columned strip part 20 having a left and a right columns 21, 22 in the same manner as illustrated in FIG. 1I.

Figure 1J:
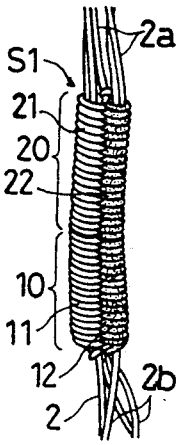

When both of the strip parts 10 and 20 are slid down onto the core yarns 2 and retained thereon tightly with each other, a needlewoven strip S1 is obtained, as illustrated in FIG. 1J. The needlewoven strip S1 thus formed can be separated from the needles 1*a*, 1*b* by cutting the upper ends 2*a* of the core yarns 2 by means of an available edged tool (not shown). The strip S1 can be prevented from being undesirably disassembled by simply tying the opposite ends 2*a* and 2*b*, respectively, as shown in FIG. 2C.

In the above operation, connection between the surface yarns 10*a* and 20*a*, for example, may be made by simply tying the upper end of the former with the lower end of the latter. Otherwise, the surface yarn 20*a* may be formed in its lower end with a described slip knot to be slid onto the first needle 1*a* at a position next to the upper end of the surface yarn 10*a*.

The needlewoven strip S1 may have various patterns by selecting colors of the surface yarns. For example, when the surface yarns 10*a*, 20*a* forming the left column 11, 21 of the strip S1 are of one color while the surface yarns 10*b*, 20*b* forming the right column 12, 22 are of another color, a pattern of vertical stripes of two different colors is obtained, as illustrated in FIG. 1J.

By contrast, when the first pair of surface yarns 10*a* and 10*b* forming the first strip part 10 are of one color while the second pair of surface yarns 20*a* and 20*b* forming the second strip part 20 are of another color, a pattern of lateral stripes of two different colors is obtained (not illustrated). It is also possible to obtain some other patterns by varying color combination among the surface yarns 10*a*, 10*b*, 20*a*, 20*b*.

Figure 2A:
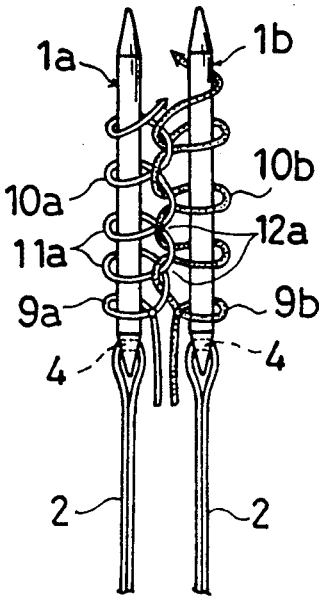
FIGS. 2A to 2C are views showing the successive steps for making a modified two-columned needlewoven strip.
Figure 2B:
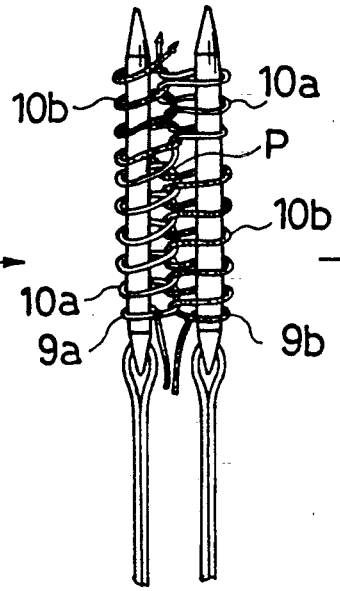
Figure 2C:
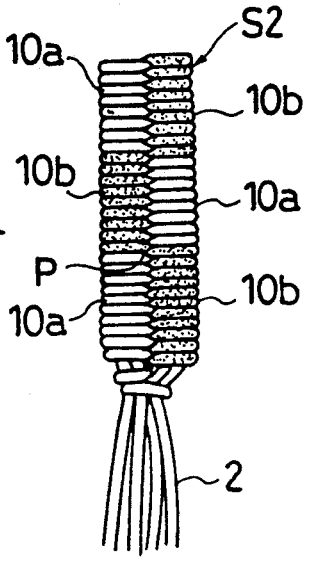

FIGS. 2A to 2C illustrate a modification of the example shown in FIGS. 1A to 1J. The step of FIG. 2A corresponds to that of FIG. 1G. However, the next step is modified to change the looping positions of the surface yarns 10*a*, 10*b* in order to give a checkered pattern to a needlewoven strip S2 as illustrated in FIG. 2C. This can be done by making the first pair of surface yarns 10*a*, 10*b* crisscrossed at a desired intermediate change point P, as illustrated in FIG. 2B.

Figure 3A:
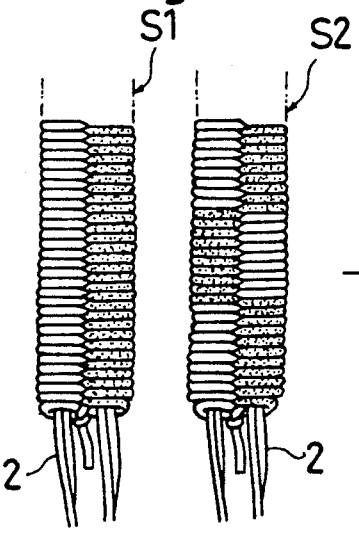
FIGS. 3A to 3C are views showing a typical way for assembling a plurality of needlewoven strips into an intended project.
Figure 3B:
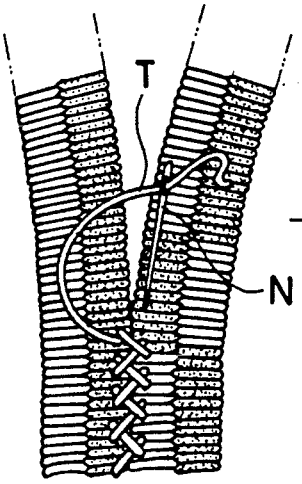
Figure 3C:
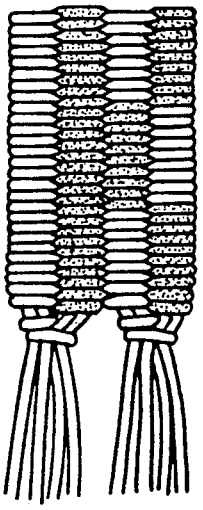

In order to form an intended project, a number of woven strips are sewn together with a known tapestry needle N and a known stitching thread T, as illustrated in FIG. 3B. It will be easily understood that any intended projects can be provided with various combinations of different needlewoven strips. For example, when the described strips S1 and S2 are sewn together as illustrated in FIG. 3A, a combination pattern as illustrated in FIG. 3C is obtained.

Figure 4A:
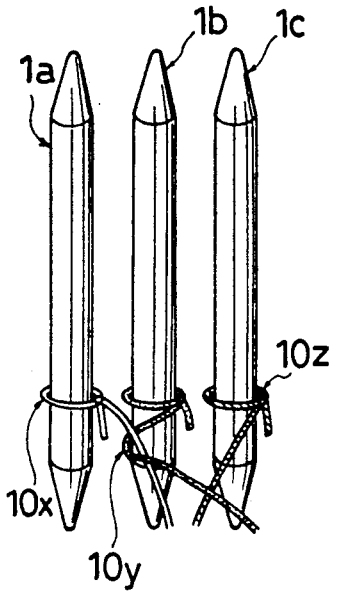
FIGS. 4A to 4F are views showing the successive steps for making a three-columned needlewoven strip according to the invention.
Figure 4B:
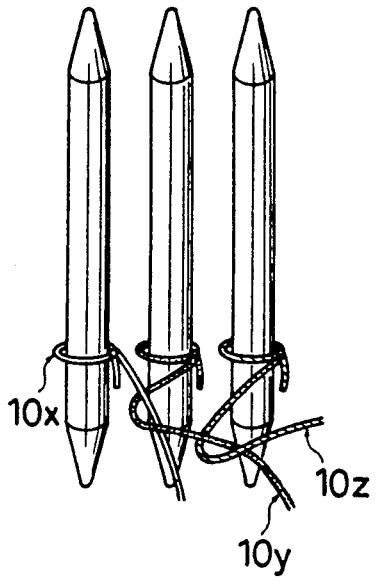
Figure 4C:
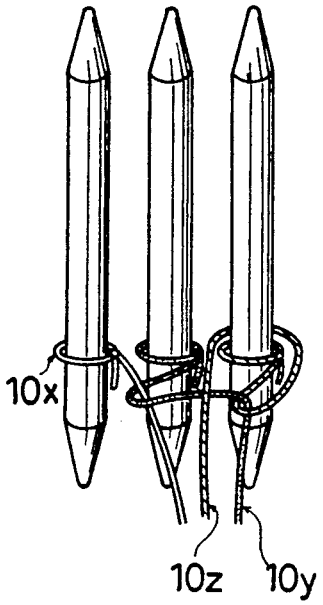
Figure 4D:
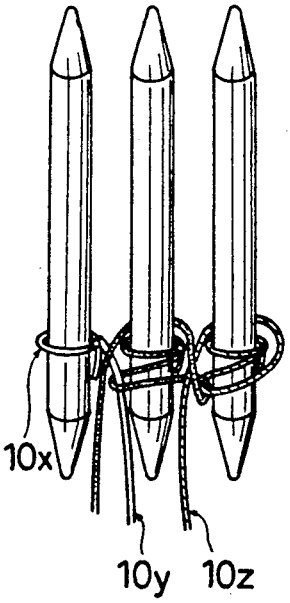
Figure 4E:
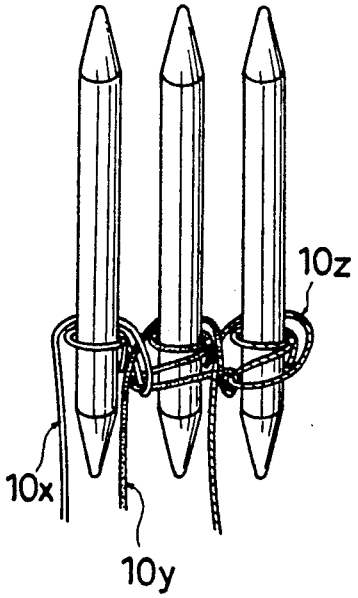
Figure 4F:
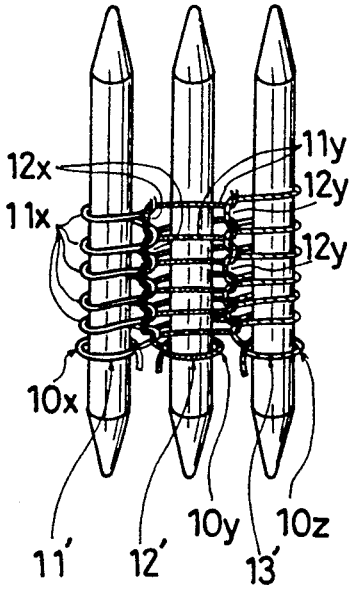
Figure 5A:
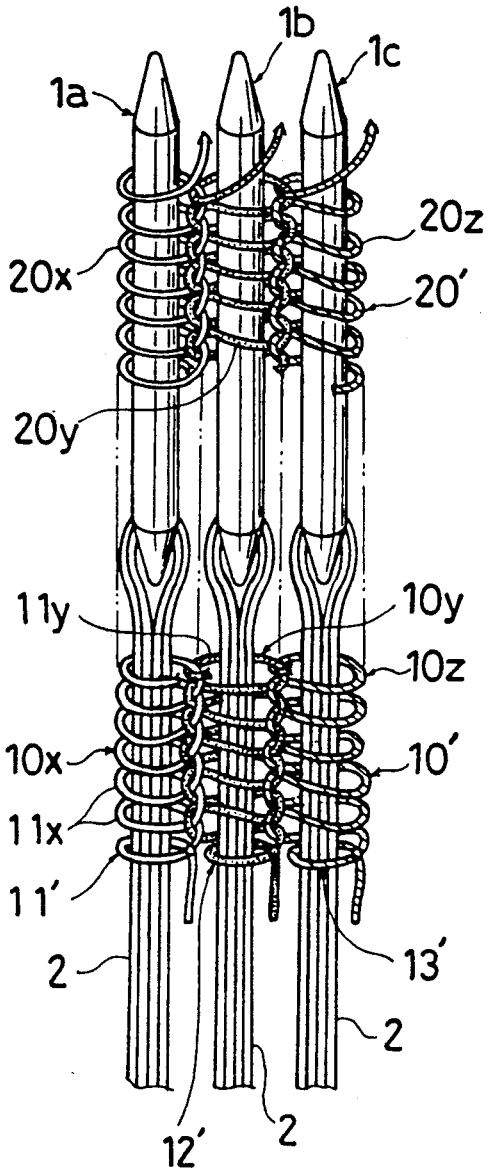
FIGS. 5A to 5B are views similar to FIGS. 1I and 1J but respectively showing the final step of making the three-columned needlewoven strip and the resulting strip.
Figure 5B:
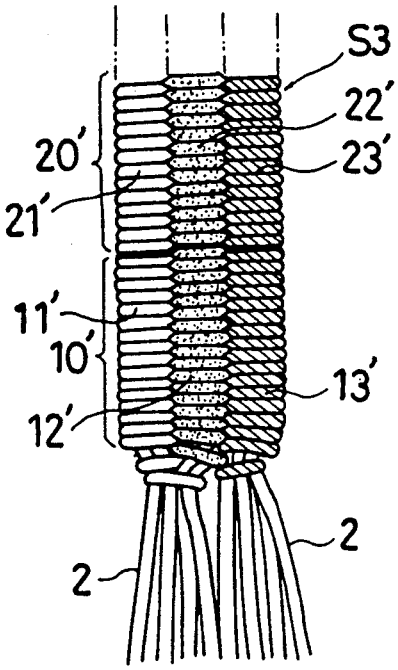

FIGS. 4A to 4F illustrate another example of the invention, wherein three weaving needles 1*a*, 1*b*, 1*c* each having the same structure as described hereinbefore, are used to make a three-columned needlewoven strip S3 as shown in FIG. 5B.

In the weaving operation, with a first or left surface yarn 10*x* is interlocked with a second or intermediate surface yarn 10*y* which is in turn interlocked and with a third or right surface yarn 10*z*, as illustrated in FIGS. 4A and 4B. Then, the third surface yarn 10*z* is looped or wound counterclockwise around the third needle 1*c*, as illustrated in FIG. 4C. Then, the second surface yarn 10*y* is crossed with the third surface yarn 10*z* and wound counterclockwise around the second needle 1*b*, as illustrated in FIG. 4D. Then, the first surface yarn 10*x* is crossed with the second surface yarn 10*y* and looped counterclockwise around the first needle la, as illustrated in FIG. 4E.

Again, the third surface yarn 10*z* is interlocked with the second surface yarn 10*y* and looped counterclockwise around the third needle 1*c*, in the same manner as described and illustrated with FIGS. 4A to 4C. The subsequent steps are taken in the same manner as described and illustrated with FIGS. 4D and 4E.

By repeating the same steps of FIGS. 4A to 4E, the surface yarns 10*x*, 10*y*, 10*z* are woven into a first three-columned strip part 10′ having three columns 11′, 12′, 13′ disposed on the respective weaving needles 1*a*, 1*b*, 1*c* as shown in FIG. 4F.

The first or left column 11′ has a series of loops 11*x* each of which is interlocked with and closed by the second surface yarn 10*y* at 12*x* as illustrated in FIG. 4F while the second or intermediate column 12′ has a series of loops 11*y* each of which is interlocked with and closed by the third surface yarn 10*z* at 12*y* as also illustrated in FIG. 4F. Thus, the three columns 11′, 12′, 13′ are all connected together.

After the first strip part 10′ is slid down onto the three hanging core yarns 2 as illustrated in FIG. 5A, a second group of surface yarns 20*x*, 20*y*, 20*z* are woven into a second three-columned strip part 20′ having three columns 21′, 22′, 23′ in the same manner as described.

When both of the strip parts 10′ and 20′ are slid down onto the cores 2 and retained thereon in a tightly gathered condition, a three-columned woven strip S3 is obtained, as illustrated in FIG. 5B.

The needlewoven strip S3 may also have various patterns by selecting colors of the surface yarns. For example, when the surface yarns 10*x*, 20*x* forming the left column 11′, 21′ of the strip S1 are of one color while the surface yarns 10*y*, 20*y* forming the intermediate column 12′, 22′ are of another color and when the surface yarns 10*z*, 20*z* forming the right column 13′, 23′ are of a further different color, a pattern of vertical stripes of three different colors is obtained, as illustrated in FIG. 5B.

By contrast, when the surface yarns 10*x*, 10*y*, 10*z* are of one color while the surface yarns 20*x*, 20*y*, 20*z* are of another color, a pattern of lateral strips of two different colors is obtained (not shown). It is also possible to obtain some other patterns by varying color combination among the surface yarns 10*x*, 10*y*, 10*z*, 20*x*, 20*y*, 20*z*.

Figure 7A:
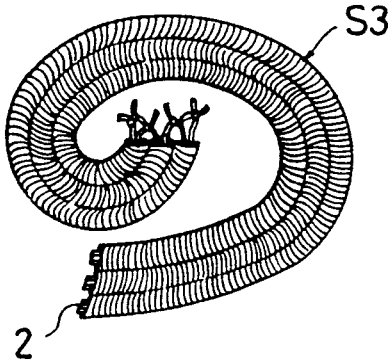
FIGS. 7A and 7B are views showing how to make a round project from a plurality of three-columned needlewoven strips.
Figure 7B:
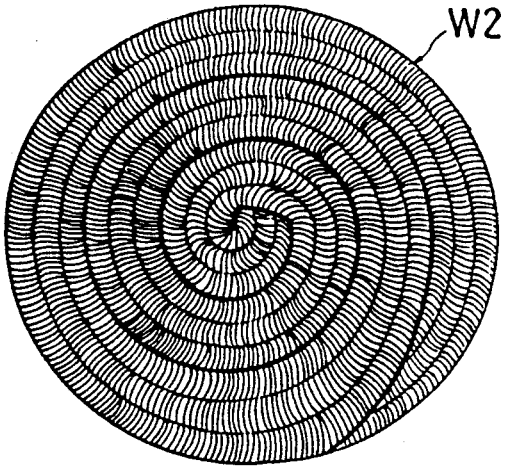

Each of the needlewoven strips having two or three columns described above can easily deformed into various configurations. For example, it can be spirally deformed as shown in FIG., 7A. Thus, it is possible to form a round finished project W2 by sewing plurality of such woven strips together, as illustrated in FIG. 7B such round projects W2 having a scrolled pattern.

Figure 8A:
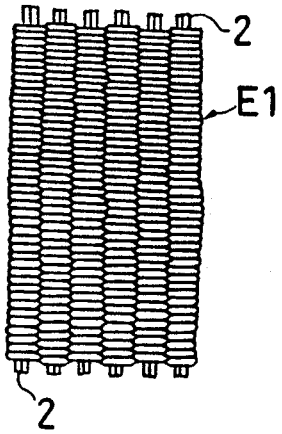
FIGS. 8A to 8C are views showing three different patches obtainable according to the present invention.
Figure 8B:
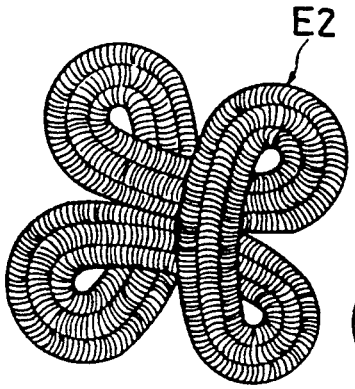
Figure 8C:
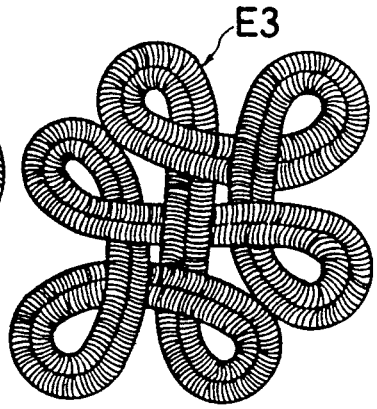
Figure 9A:
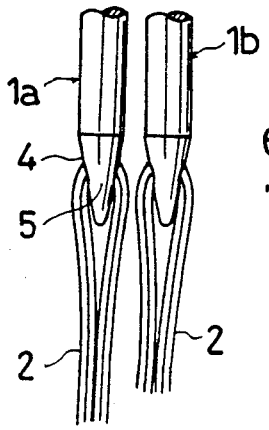
PRIOR ART Fig. 9A
FIGS. 9A to 9D are views showing the successive steps for making a two-columned needlewoven strip according to a prior art method.
Figure 9B:
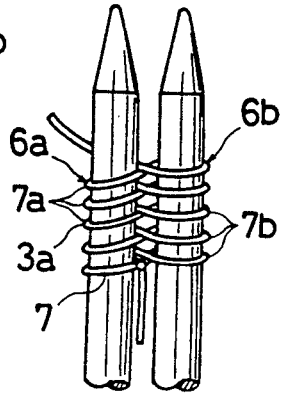
Figure 9C:
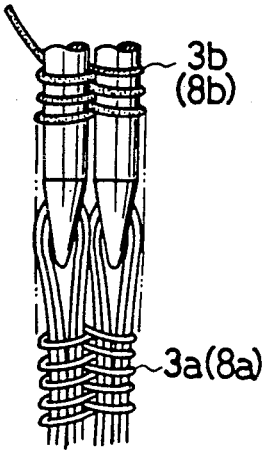
Figure 9D:
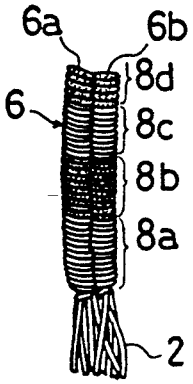
Figure 10A:
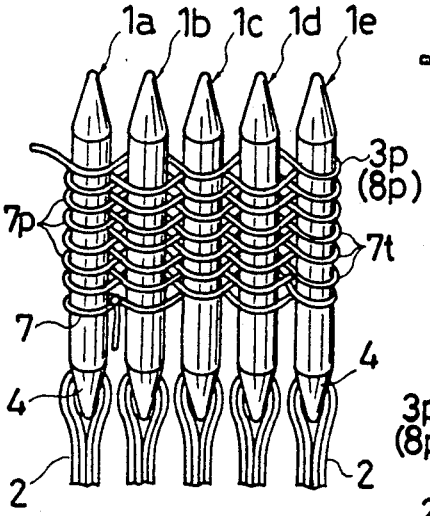
PRIOR ART Fig. 10A
FIGS. 10A to 10C are views showing the successive steps for making a five-columned needlewoven strip according to the prior art method.
Figure 10B:
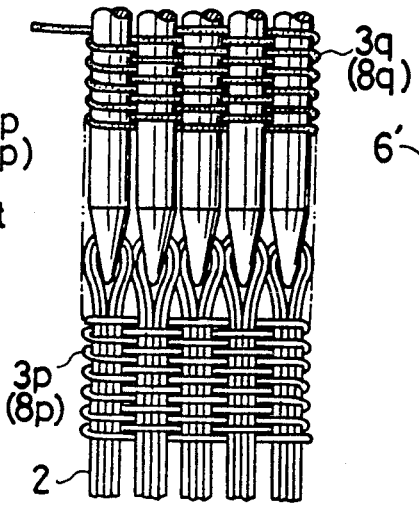
Figure 10C:
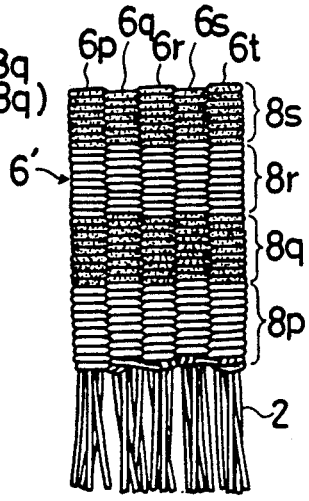

FIGS. 8A to 8C illustrate these examples E1, E2, E3 among various needlewoven patches which can be made by sewing a plurality of needlewoven strips together. The example El is a square patch which is conveniently used to make any two- or three- dimensional finished projects by connecting a number of such patches El together.

Figure 6:
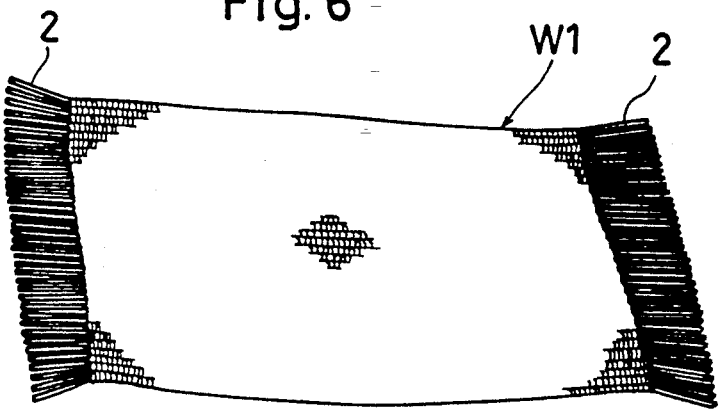
FIG. 6 is a perspective view showing an example of a finished project which can be made by connecting a plurality of needlewoven strips together.

Illustrated in FIG. 6 is a typical example of application of the square patches El connected together, in which a number of core yarns 2 are used as tassels for both ends of the projects W1. If the core yarns are long enough, they may be braided as desired.

Each core yarn 2 may consist of one strand as illustrated in FIG. IA or consist of two or more strands, as illustrated in FIG. 5A. If a relatively thick project is intended, the number of strands forming each core yarn may be increased. On the other hand, when a relatively thin project is intended, all or some of the core yarns 2 may be removed from the needlewoven strips or patches by simply pulling them out in their axial direction before the strips or patches are connected together to form the intended project.

Different from the described known method, the multi-columned needlewoven strips or patches formed according to the present invention are not easily disassembled or broken even when all the core yarns of one strip or patch are removed, since each column of the strip or patch is tied with an adjacent column or columns while none of the core yarns are interlocked or tied with the surface yarns.

Further, it will be apparent that the core yarn or yarns may be replaced by any other suitable flexible cord or cords available in the market.

The other needlewoven example E2, E3 are conveniently used for the purposes of ornamentation or decoration. For instance, the example E2, E3 may be attached, independently or in combination, to a fabric or other surface of any articles, although they may also be used to form any substantially two- or three-dimensional projects by connecting a number of them together.

The present invention being thus described, it will be obvious that same may be varied in many ways. Such variations are not to be regarded as a departure from the spirit and scope of the invention, and all such modifications as would be obvious to one skilled in the art are intended to be included within the scope of the following claims.

I claim:

1. A multi-columned needlewoven strip comprising:

a first column including a series of loops of a first surface yarn which has loop closing intersections, wherein said intersections comprise points at which the yarn abuts itself to define a closed loop,; and a second column including a series of loops of a second surface yarn, said second column being disposed adjacent and in parallel to said first column, said second surface yarn interlocking with said first surface yarn between said first and second columns for connecting said first and second columns together;

wherein said loops of said first surface yarn are closed by said second surface yarn at said loop closing intersections where said second surface yarn interlocks with said first surface yarn.

2. The strip according to claim 1, wherein each of said first and second columns has a core yarn extending axially through a corresponding series of loops.

3. The strip according to claim 1, wherein said first column further includes an additional series of loops formed of said second surface yarn which has been shifted in looping path from said second column to said first column, said second column further including an additional series of loops formed of said first surface yarn which has been shifted in looping path from said first column to said second column.

4. The strip according to claim 1, wherein said first and second surface yarns are different in color.

5. The strip according to claim 1 further comprising a third column including a series of loops formed of a third surface yarn, said third column being disposed adjacent and in parallel to said second column, said third surface yarn interlocking with said second surface yarn between said second and third columns, said loops of said third surface yarn being closed by said second surface yarn at positions where said third surface yarn interlocks with said second surface yarn.

6. The strip according to claim 5, wherein each of said first to third columns has a core yarn extending axially through a corresponding series of loops.

7. The strip according to claim 5, wherein said first to third surface yarns are different in color.

* * * * *